US011848488B2

(12) United States Patent
Oh et al.

(10) Patent No.: US 11,848,488 B2
(45) Date of Patent: Dec. 19, 2023

(54) ANTENNA ELEMENT AND DISPLAY DEVICE INCLUDING THE SAME

(71) Applicant: DONGWOO FINE-CHEM CO., LTD., Jeollabuk-do (KR)

(72) Inventors: Yun Seok Oh, Gyeonggi-do (KR); Young Ju Kim, Gyeonggi-do (KR); Hee Jun Park, Gyeonggi-do (KR); Won Hee Lee, Gyeonggi-do (KR); Jae Hyun Lee, Gyeonggi-do (KR)

(73) Assignee: DONGWOO FINE-CHEM CO., LTD., Jeollabuk-do (KR)

( * ) Notice: Subject to any disclaimer, the term of this patent is extended or adjusted under 35 U.S.C. 154(b) by 0 days.

(21) Appl. No.: 17/699,540

(22) Filed: Mar. 21, 2022

(65) Prior Publication Data

US 2022/0311133 A1 Sep. 29, 2022

(30) Foreign Application Priority Data

Mar. 24, 2021 (KR) ..... 10-2021-0037953

(51) Int. Cl.
*H01Q 1/24* (2006.01)
*H01Q 1/36* (2006.01)

(52) U.S. Cl.
CPC ..... *H01Q 1/36* (2013.01); *H01Q 1/243* (2013.01)

(58) Field of Classification Search
CPC .. H01Q 1/24; H01Q 1/36; H01Q 1/38; H01Q 1/424; H01Q 1/425; H01Q 9/04; H01Q 9/0407
See application file for complete search history.

(56) References Cited

U.S. PATENT DOCUMENTS 6,452,549 B1 * 9/2002 Lo ..... H01Q 21/064 343/756
2009/0051620 A1 * 2/2009 Ishibashi ..... H01Q 9/16 343/897
2010/0013714 A1 * 1/2010 Azhari ..... H01Q 5/378 343/700 MS
2015/0255856 A1 * 9/2015 Hong ..... H01Q 21/061 343/702
2020/0203830 A1 * 6/2020 Tsuchiya ..... H01Q 21/30
2020/0266526 A1 * 8/2020 Choi ..... H01Q 1/243
2020/0403301 A1 * 12/2020 Ryu ..... H01Q 1/364
2022/0255215 A1 * 8/2022 Park ..... H01Q 9/045

FOREIGN PATENT DOCUMENTS

KR 10-1303875 B1 9/2013

* cited by examiner

*Primary Examiner* — Thai Pham
(74) *Attorney, Agent, or Firm* — The PL Law Group, PLLC

(57) ABSTRACT

An antenna element according to an exemplary embodiment includes a dielectric layer; and an antenna pattern formed in a mesh structure on the dielectric layer and including an irregularly-shaped edge. The antenna element according to the example is excellent in terms of the pattern visibility, while maintaining the antenna performance.

8 Claims, 17 Drawing Sheets

(a)

(b)

ANTENNA ELEMENT AND DISPLAY DEVICE INCLUDING THE SAME

CROSS-REFERENCE TO RELATED APPLICATION(S)

This application claims priority to Korean Patent Application No. 10-2021-0037953 filed on Mar. 24, 2021 in the Korean Intellectual Property Office (KIPO), the entire disclosure of which is incorporated by reference herein.

BACKGROUND

1. Field of the Invention

The present invention relates to an antenna element and a display device including the same.

2. Description of the Related Art

Recently, according to development of the information-oriented society, wireless communication techniques such as Wi-Fi, Bluetooth, and the like are implemented, for example, in a form of smartphones by combining with display devices. In this case, an antenna may be coupled to the display device to perform a communication function.

Recently, with mobile communication techniques becoming more advanced, it is necessary for an antenna for performing communication in high frequency or ultra-high frequency bands to be coupled to the display device. In addition, according to development of thin, high-transparency and high-resolution display devices such as a transparent display and a flexible display, it is necessary to develop an antenna so as to also have improved transparency and flexibility.

As the size of a screen of the display device on which the antenna is mounted is increased, a space or area of a bezel part or light-shielding part has been decreased. In this case, the space or area in which the antenna can be embedded may also be limited.

Therefore, it is necessary to design an antenna capable of radiating a signal with a high antenna gain in a limited space without being viewed by the user.

SUMMARY

It is an object of the present invention to provide an antenna element and a display device including the same.

To achieve the above object, the following technical solutions are adopted in the present invention.

1. An antenna element including: a dielectric layer; and an antenna pattern which is formed in a mesh structure on the dielectric layer and includes an irregularly-shaped edge.
2. The antenna element according to the above 1, wherein a shape of the edge depends on positions and shapes of outermost unit cells forming the antenna pattern.
3. The antenna element according to the above 2, wherein the outermost unit cells have the same size and shape as those of the remaining unit cells except for the outermost unit cells.
4. The antenna element according to the above 2, wherein the outermost unit cells have a different size or shape from that of the remaining unit cells except for the outermost unit cells.

5. The antenna element according to the above 1, wherein the antenna pattern includes: a radiation body; and a transmission line which extends from the radiation body.
6. The antenna element according to the above 5, further including: a signal pad connected to an end of the transmission line; and a ground pad disposed around the signal pad.
7. The antenna element according to the above 6, wherein the signal pad and the ground pad are formed in a solid structure.
8. The antenna element according to the above 1, further including a dummy pattern disposed around the antenna pattern so as to be electrically and physically separated from the antenna pattern.
9. A display device including the antenna element according to the above 1.

The antenna element according to an exemplary embodiment may include a non-flat part formed on an outer periphery of the antenna pattern. The non-flat part includes a plurality of concaves and convexes, and the plurality of concaves and convexes may be irregularly or randomly formed on the outer periphery the antenna pattern. Thereby, it is possible to maintain the antenna performance by the antenna element and reduce the pattern from being viewed by a user ('pattern visibility').

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Figure 1:
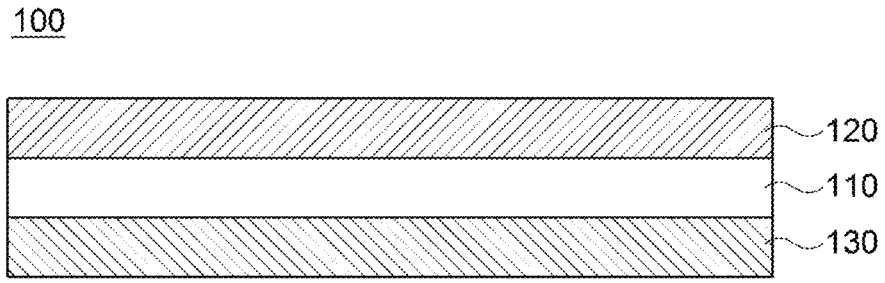
FIG. 1 is a schematic cross-sectional view illustrating an antenna element according to an exemplary embodiment.

Hereinafter, preferred embodiments of the present invention will be described in detail with reference to the accompanying drawings. However, since the drawings attached to the present disclosure are only given for illustrating one of several preferred embodiments of present invention to easily understand the technical spirit of the present invention with the above-described invention, it should not be construed as limited to such a description illustrated in the drawings.

An antenna element described in the present disclosure may be a microstrip patch antenna manufactured in a form of a transparent film. For example, the antenna element may be applied to electronic devices for high frequency or ultra-high frequency (e.g., 3G, 4G, 5G or more) mobile communication, Wi-Fi, Bluetooth, near field communication (NFC), global positioning system (GPS), and the like, but it is not limited thereto. Herein, the electronic device may include a mobile phone, a smartphone, a tablet, a laptop computer, a personal digital assistant (PDA), a portable multimedia player (PMP), a navigation device, an MP3 player, a digital camera, a wearable device and the like. The wearable device may include a wristwatch type, a wrist band type, a ring type, a belt type, a necklace type, an ankle band type, a thigh band type, a forearm band type wearable device or the like. However, the electronic device is not limited to the above-described example, and the wearable device is also not limited to the above-described example. In addition, the antenna element may be applied to various objects or structures such as vehicles and buildings.

In the following drawings, two directions which are parallel to an upper surface of a dielectric layer and intersect each other perpendicularly are defined as an x direction and a y direction, and a direction perpendicular to the upper surface of the dielectric layer is defined as a z direction. For example, the x direction may correspond to a width direction of the antenna element, the y direction may correspond to a length direction of the antenna element, and the z direction may correspond to a thickness direction of the antenna element.

FIG. 1 is a schematic cross-sectional view illustrating an antenna element according to an exemplary embodiment.

Referring to FIG. 1, an antenna element 100 according to an exemplary embodiment may include a dielectric layer 110 and an antenna pattern layer 120.

The dielectric layer 110 may include an insulation material having a predetermined dielectric constant. According to an embodiment, the dielectric layer 110 may include an inorganic insulation material such as glass, silicon oxide, silicon nitride, or metal oxide, or an organic insulation material such as an epoxy resin, an acrylic resin, or an imide resin. The dielectric layer 110 may function as a film substrate of the antenna element 100 on which the antenna pattern layer 120 is formed.

According to an embodiment, a transparent film may be provided as the dielectric layer 110. In this case, the transparent film may include a polyester resin such as polyethylene terephthalate, polyethylene isophthalate, polyethylene naphthalate, polybutylene terephthalate, etc.; a cellulose resin such as diacetyl cellulose, triacetyl cellulose, etc.; a polycarbonate resin; an acrylic resin such as polymethyl (meth)acrylate, polyethyl (meth)acrylate, etc.; a styrene resin such as polystyrene, acrylonitrile-styrene copolymer, etc.; a polyolefin resin such as polyethylene, polypropylene, cyclic polyolefin or polyolefin having a norbornene structure, ethylene-propylene copolymer, etc.; a vinyl chloride resin; an amide resin such as nylon, aromatic polyamide; an imide resin; a polyether sulfonic resin; a sulfonic resin; a polyether ether ketone resin; a polyphenylene sulfide resin; a vinylalcohol resin; a vinylidene chloride resin; a vinylbutyral resin; an allylate resin; a polyoxymethylene resin; a thermoplastic resin such as an epoxy resin and the like. These compounds may be used alone or in combination of two or more thereof. In addition, a transparent film made of a thermosetting resin or an ultraviolet curable resin such as (meth)acrylate, urethane, acrylic urethane, epoxy, silicone, and the like may be used as the dielectric layer 110.

According to an embodiment, an adhesive film such as an optically clear adhesive (OCA), an optically clear resin (OCR), and the like may also be included in the dielectric layer 110.

According to an embodiment, the dielectric layer 110 may be formed in a substantial single layer, or may be formed in a multilayer structure of two or more layers.

Capacitance or inductance may be generated by the dielectric layer 110, thus to adjust a frequency band which can be driven or sensed by the antenna element 100. When the dielectric constant of the dielectric layer 110 exceeds about 12, a driving frequency is excessively reduced, such that driving of the antenna in a desired high frequency band may not be implemented. Therefore, according to an embodiment, the dielectric constant of the dielectric layer 110 may be adjusted in a range of about 1.5 to 12, and preferably about 2 to 12. Further, according to an embodiment, the dielectric layer 110 may be formed in a thickness of 4 μm to 1000 μm so that the antenna element 100 can be driven in a desired high frequency band. However, it is not limited thereto, and the dielectric constant and thickness of the dielectric layer 110 may be variously altered according to a desired frequency band.

According to an embodiment, an insulation layer (e.g., an encapsulation layer, a passivation layer, etc. of a display panel) inside the display device on which the antenna element 100 is mounted may be provided as the dielectric layer 110.

The antenna pattern layer 120 may be disposed on an upper surface of the dielectric layer 110.

The antenna pattern layer 120 may include low resistance metal such as silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), zinc (Zn), tin (Sn), molybdenum (Mo), calcium (Ca), or an alloy including at least one thereof. These may be used alone or in combination of two or more thereof. For example, the antenna pattern layer 120 may include silver (Ag) or a silver alloy (e.g., a silver-palladium-copper (APC) alloy) to implement a low resistance. As another example, the antenna pattern layer 120 may include copper (Cu) or a copper alloy (e.g., a copper-calcium (CuCa) alloy) in consideration of low resistance and fine line width patterning.

According to an embodiment, the antenna pattern layer 120 may include a transparent conductive oxide such as indium tin oxide (ITO), indium zinc oxide (IZO), indium zinc tin oxide (IZTO), zinc oxide (ZnOx), or copper oxide (CuO).

According to an embodiment, the antenna pattern layer 120 may include a lamination structure of a transparent conductive oxide layer and metal layer, for example, and may have a two-layer structure of transparent conductive oxide layer-metal layer or a three-layer structure of transparent conductive oxide layer-metal layer-transparent conductive oxide layer. In this case, resistance may be reduced to improve signal transmission speed while improving flexible properties by the metal layer, and corrosion resistance and transparency may be improved by the transparent conductive oxide layer.

According to an embodiment, the antenna pattern layer 120 may be subjected to blackening treatment. For example, the surface of the antenna pattern layer 120 may be subjected to thermal oxidization, thereby reducing reflectance. Accordingly, it is possible to reduce the pattern from being viewed due to light reflection on the surface of the antenna pattern layer 120.

A surface portion of a metal layer of the antenna pattern layer 120 may be subjected to blackening treatment to form a blackened layer in which a portion of the metal layer is made of metal oxide or metal sulfide. Further, a blackened layer such as a coating film of a black material, or a plating layer of metal such as nickel and chromium may be formed on the metal layer.

The blackened layer is intended to improve transparency and visibility of the metal layer by reducing the reflectance of the metal layer, and may include, for example, at least one of silicon oxide, metal oxide, copper, molybdenum, carbon, tin, chromium, nickel and cobalt.

The composition and thickness of the blackened layer may be variously adjusted according to a desired degree of blackening.

Specific details of the antenna pattern layer 120 will be described below with reference to FIGS. 2 and 3A to 3I.

According to an embodiment, the antenna element 100 may further include a ground layer 130. Since the antenna element 100 includes the ground layer 130, vertical radiation characteristics may be implemented.

The ground layer 130 may be disposed on a lower surface of the dielectric layer 110. The ground layer 130 may be overlapped with the antenna pattern layer 120 with the dielectric layer 110 interposed therebetween. For example, the ground layer 130 may be entirely overlapped with a radiation body (see 211 of FIG. 2) of the antenna pattern layer 120.

According to an embodiment, a conductive member of the display device or display panel on which the antenna element 100 is mounted may be provided as the ground layer 130. For example, the conductive member may include electrodes or wirings such as a gate electrode, source/drain electrodes, pixel electrode, common electrode, data line, scan line, etc. of a thin film transistor (TFT) included in the display panel; and a stainless steel (SUS) plate, heat radiation sheet, digitizer, electromagnetic wave shielding layer, pressure sensor, fingerprint sensor, etc. of the display device.

Figure 2:
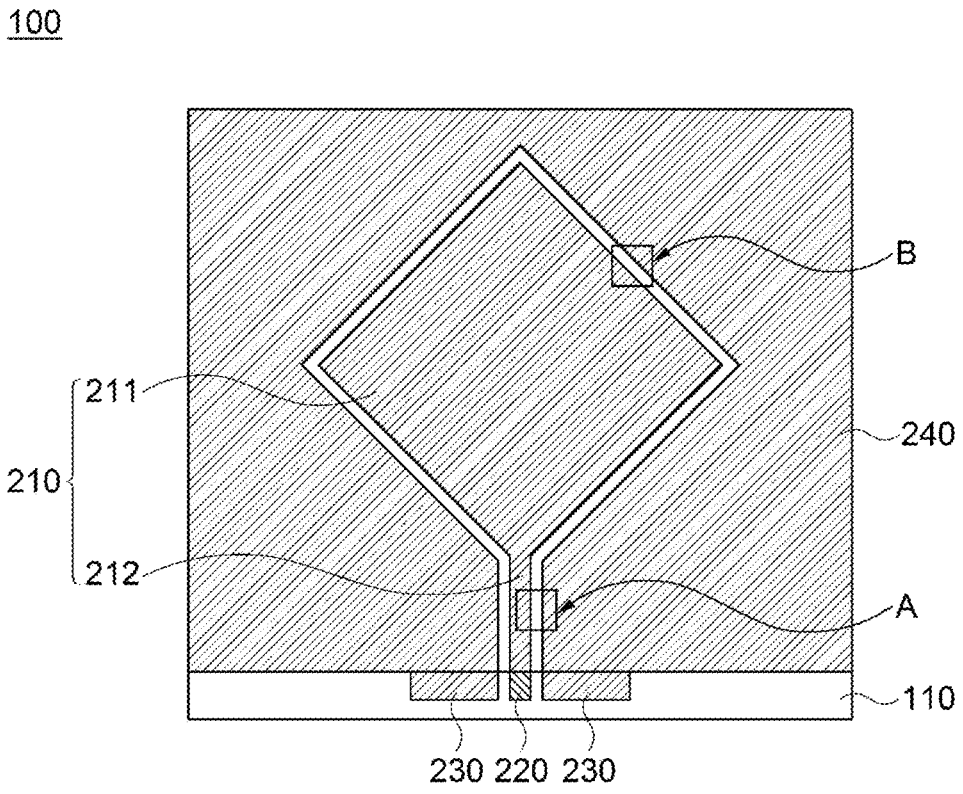
FIG. 2 is a schematic plan view illustrating an antenna element according to an exemplary embodiment.
Figure 3A:
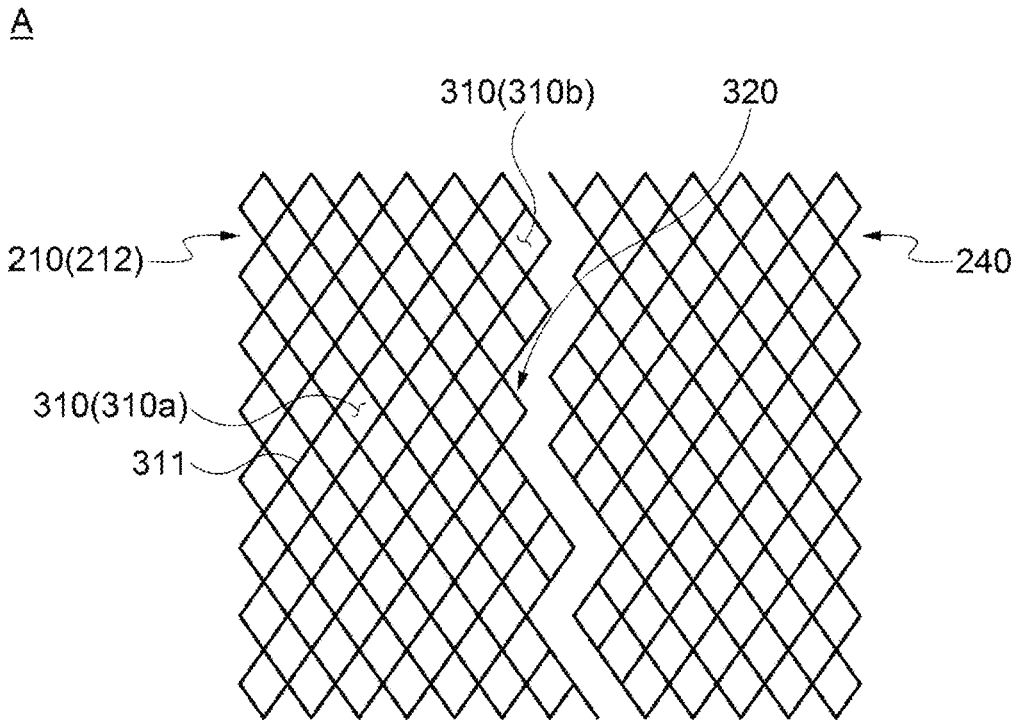
FIGS. 3A and 3B are enlarged views of portions "A" and "B" in FIG. 2 of an antenna element according to an exemplary embodiment.
Figure 3B:
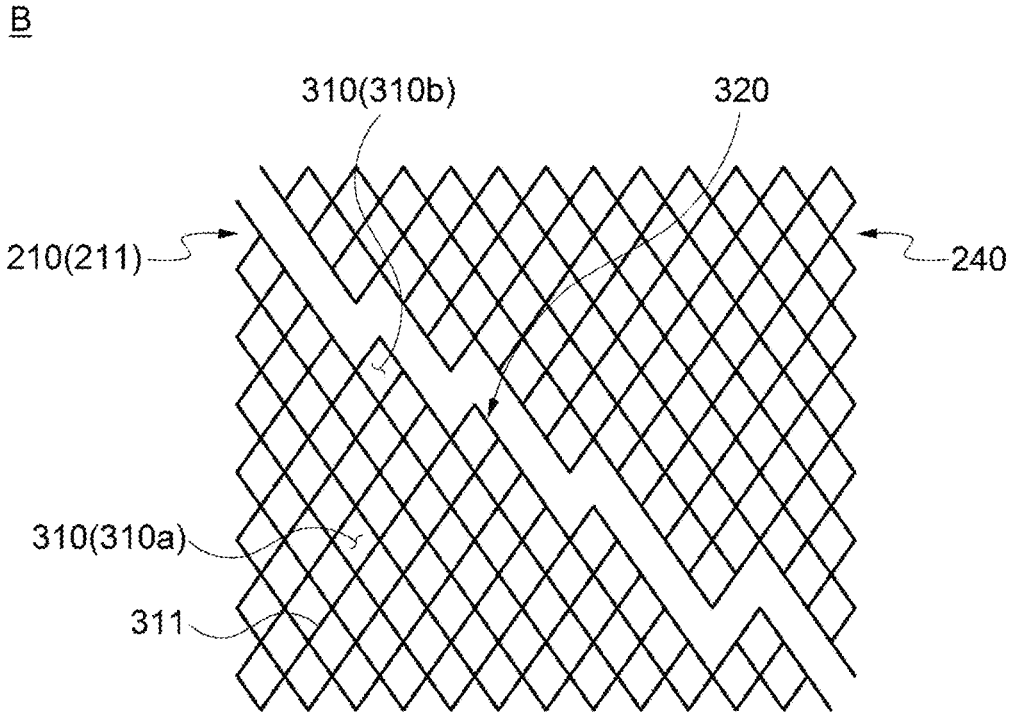
Figure 3C:
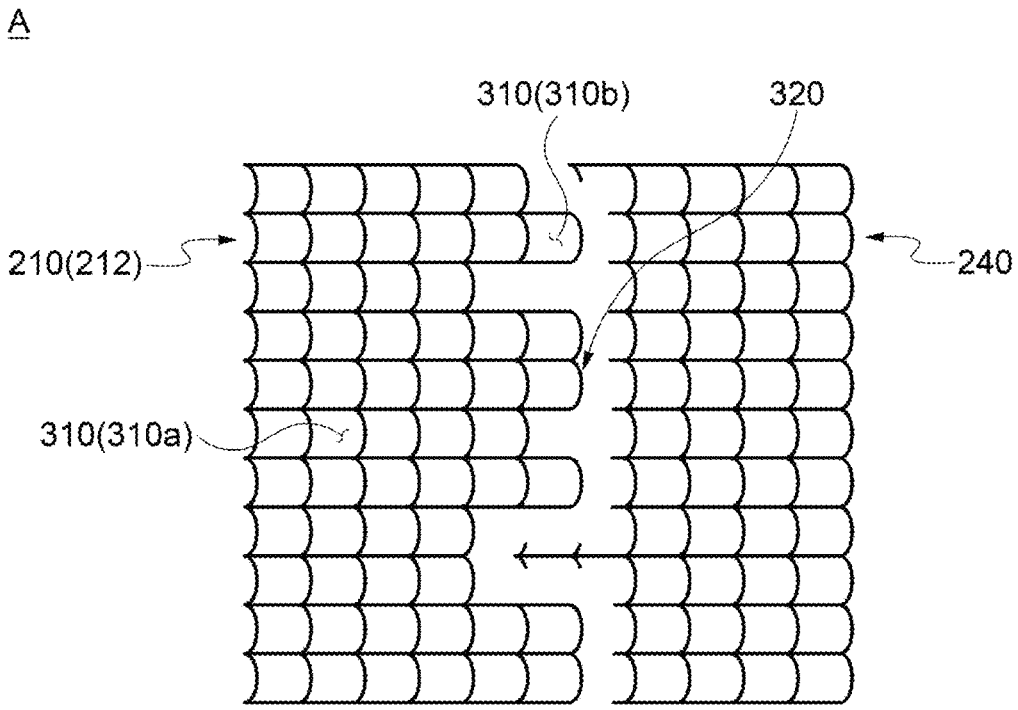
FIGS. 3C and 3D are enlarged views of the portions "A" and "B" in FIG. 2 of an antenna element according to another exemplary embodiment.
Figure 3D:
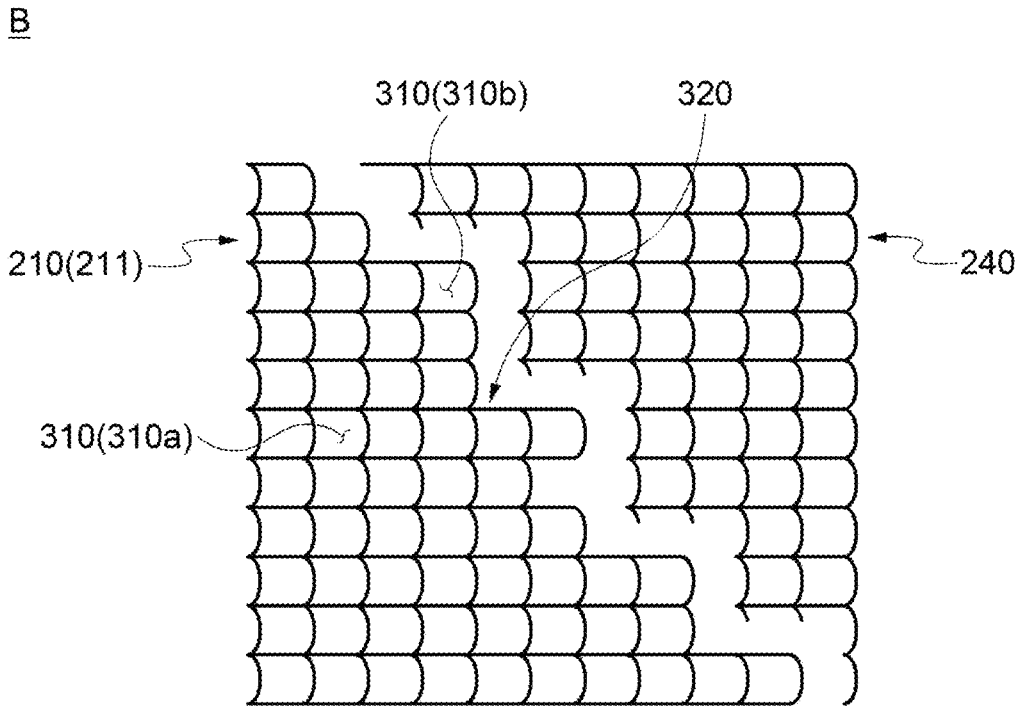
Figure 3E:
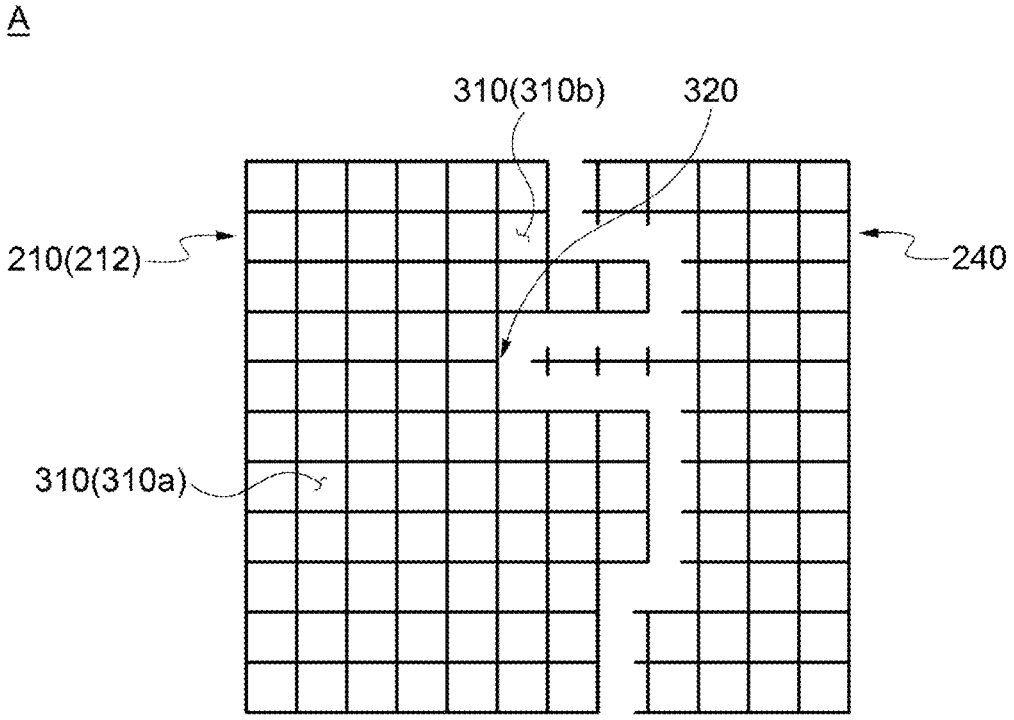
FIGS. 3E and 3F are enlarged views of the portions "A" and "B" in FIG. 2 of an antenna element according to another exemplary embodiment.
Figure 3F:
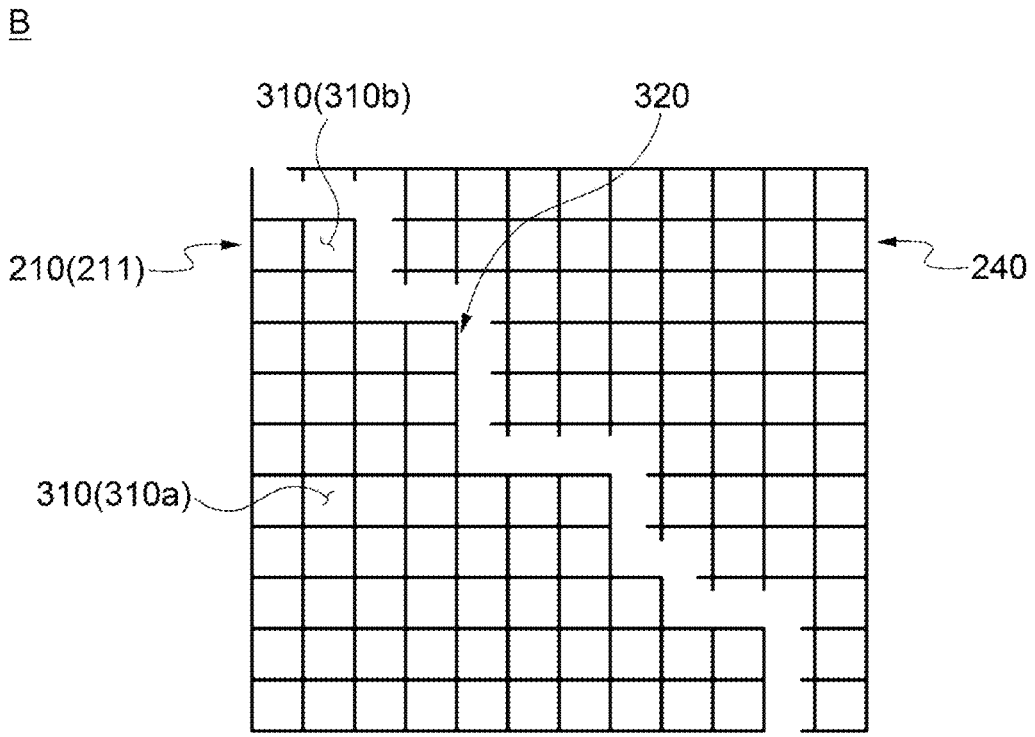
Figure 3G:
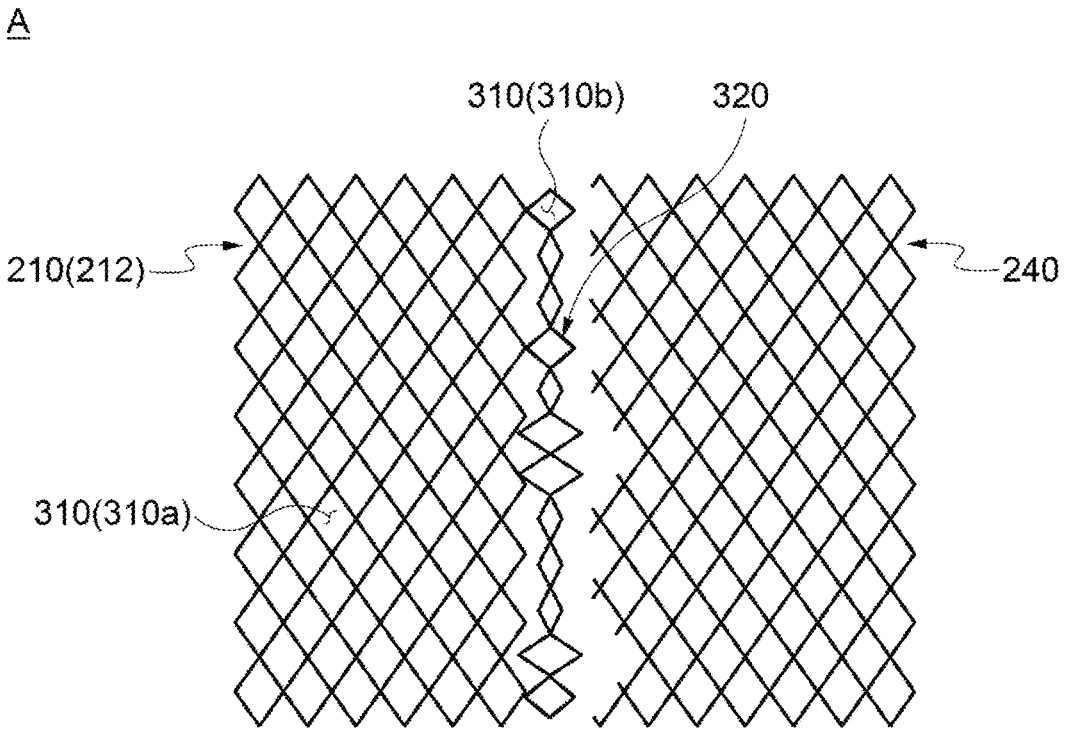
FIGS. 3G to 3I are enlarged views of the portion "A" in FIG. 2 of an antenna element according to another exemplary embodiment.
Figure 3H:
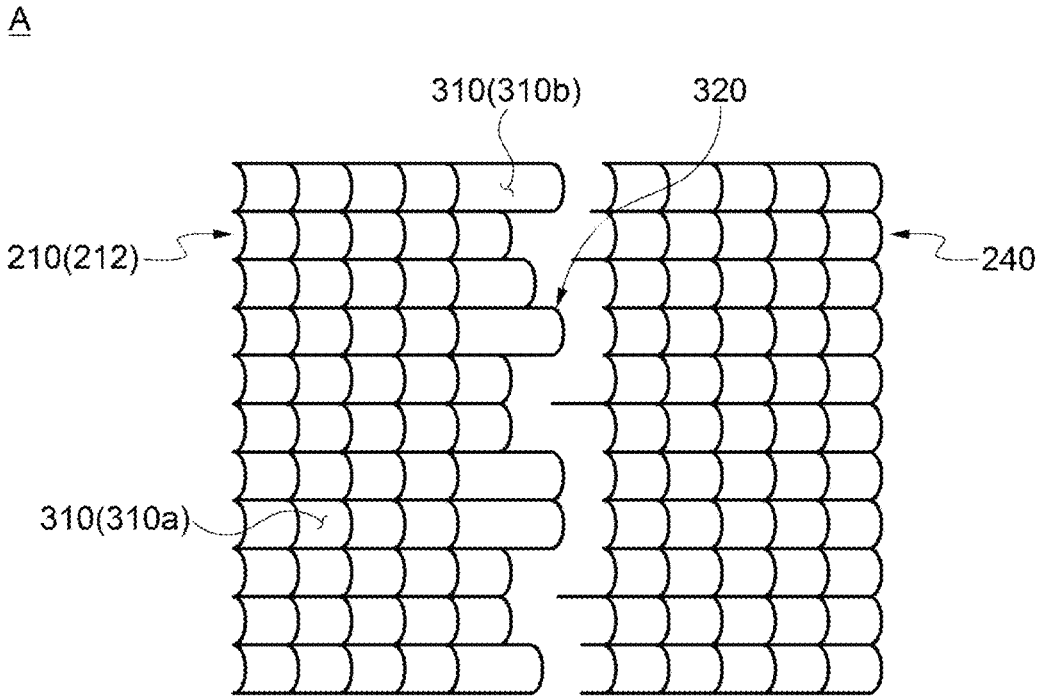
Figure 3I:
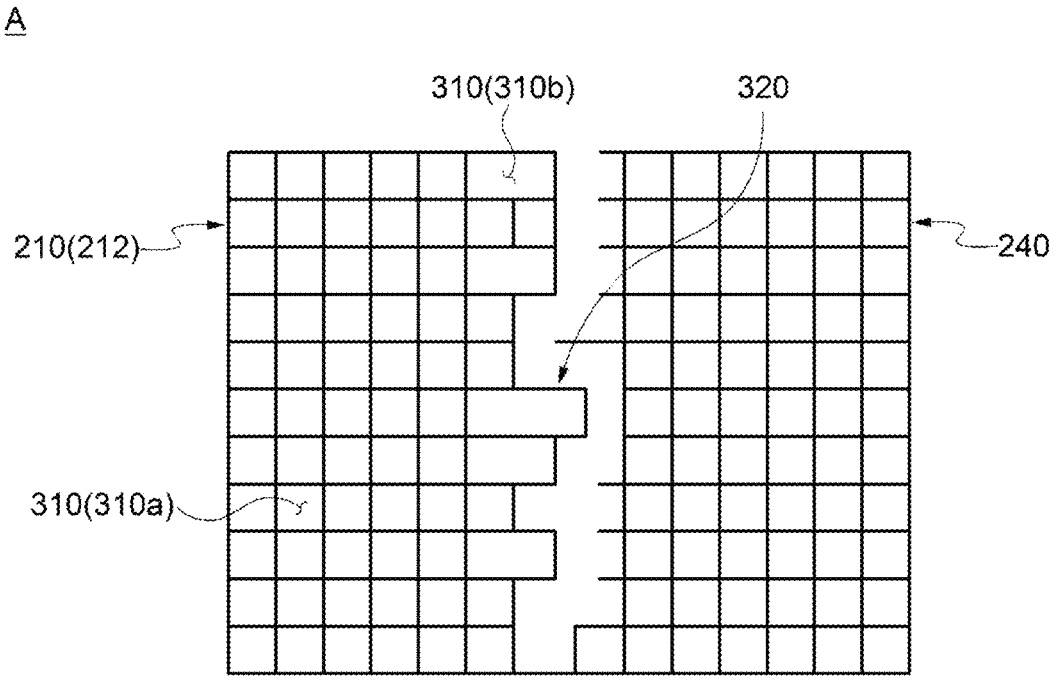

FIG. 2 is a schematic plan view illustrating an antenna element according to an exemplary embodiment, FIGS. 3A and 3B are enlarged views of portions "A" and "B" in FIG. 2 of an antenna element according to an exemplary embodiment, FIGS. 3C and 3D are enlarged views of the portions "A" and "B" in FIG. 2 of an antenna element according to another exemplary embodiment, FIGS. 3E and 3F are enlarged views of the portions "A" and "B" in FIG. 2 of an antenna element according to another exemplary embodiment, and FIGS. 3G to 3I are enlarged views of the portion "A" in FIG. 2 of an antenna element according to another exemplary embodiment.

Referring to FIGS. 2 and 3A to 3I, the antenna element 100 according to an exemplary embodiment includes an antenna pattern layer 120 disposed on the dielectric layer 110, and the antenna pattern layer 120 may include an antenna pattern 210.

The antenna pattern 210 may include the above-described metals or alloy, and may be formed in a mesh structure. The mesh structure may include a plurality of unit cells 310 defined by a plurality of conductive lines 311. The unit cells 310 may include outermost unit cells 310*b* and the remaining unit cells 310*a* except for the outermost unit cells 310*b*. As the antenna pattern 210 is formed in the mesh structure, transmittance of the antenna pattern 210 may be increased, and flexibility of the antenna element 100 may be improved. Accordingly, the antenna element 100 can be effectively applied to a flexible display device.

The antenna pattern 210 may include an irregularly-shaped edge 320. For example, the edge 320 may be formed along edges of the outermost unit cells 310*b* of the antenna pattern 210. Accordingly, the shape of the edge 320 may depend on positions and shapes of the outermost unit cells 310*b* of the antenna pattern 210. In this case, the outermost unit cells 310*b* may have the same size and shape as those of the remaining unit cells 310*a* except for the same (see FIGS. 3A to 3F), or may have different size and/or shape from those/that of the remaining unit cells 310*a* except for the same (FIGS. 3G to 3I).

For example, as shown in FIGS. 3A and 3B, the unit cells 310 may have a rhombus shape. In this case, the outermost unit cells 310*b* and the remaining unit cells 310*a* may have the same size and shape as each other.

For another example, as shown in FIGS. 3C and 3D, the unit cells 310 may have a C shape or an inverted C shape. In this case, the outermost unit cells 310*b* and the remaining unit cells 310*a* may have the same size and shape as each other. Herein, the C shape or the inverted C shape may be a shape in which an upper side and a lower side are formed in straight lines parallel to each other, and a left side and a right side are formed in curved lines parallel to each other.

For another example, as shown in FIGS. 3E and 3F, the unit cells 310 may have a rectangular shape. In this case, the outermost unit cells 310*b* and the remaining unit cells 310*a* may have the same size and shape as each other.

For another example, as shown in FIG. 3G, the unit cells 310 may have a rhombus shape. In this case, the outermost unit cells 310*b* and the remaining unit cells 310*a* may have different sizes and shapes from each other. For example, pitches of the outermost unit cells 310*b* and the remaining unit cells 310*a* may be different from each other.

For another example, as shown in FIG. 3H, the unit cells 310 may have a C shape or an inverted C shape. In this case, the outermost unit cells 310*b* and the remaining unit cells 310*a* may have different sizes and shapes from each other. For example, the pitches of the outermost unit cells 310*b* and the remaining unit cells 310*a* may be different from each other.

For another example, as illustrated in FIG. 3I, the unit cells 310 may have a rectangular shape. In this case, the outermost unit cells 310*b* and the remaining unit cells 310*a* may have different sizes and shapes from each other. For example, the pitches of the outermost unit cells 310*b* and the remaining unit cells 310*a* may be different from each other.

According to an exemplary embodiment, as the edge 320 of the antenna pattern 210 is formed in an irregular shape, when the antenna pattern 210 is disposed in a display region (e.g., a region in which visual information is displayed) of the display device, it is possible to significantly reduce or suppress the pattern from being viewed by a user.

The antenna pattern 210 may include a radiation body 211 and a transmission line 212.

The radiation body 211 may receive an electric signal from the transmission line 212, convert it into an electromagnetic wave signal, and radiate the converted electromagnetic wave signal.

The shape and size of the radiation body 211 may be determined according to the desired resonance frequency, radiation resistance and gain. According to an exemplary embodiment, the radiation body 211 may have a polygonal plate shape.

The transmission line 212 may be formed by extending from the radiation body 211. For example, the transmission line 212 may be formed to have a length of 0.5 mm to 7.0 mm so that the antenna element 100 can be driven in the desired high frequency band. However, it is not limited thereto, and the length of the transmission line 212 may be variously changed according to the desired frequency band.

According to an exemplary embodiment, the transmission line 212 may be integrally connected with the radiation body 211 to form a substantially single member, or may be formed as a separate member from the radiation body 211.

According to an exemplary embodiment, the transmission line 212 may be formed in a mesh structure having substantially the same shape (e.g., having the same line width, the same unit cell, etc.) as the radiation body 211, but it is not limited thereto, and may be formed in a mesh structure having substantially different shape from the radiation body 211.

The antenna pattern layer 120 may further include a signal pad 220.

The signal pad 220 may be connected to an end of the transmission line 212, thus to be electrically connected to the radiation body 211 through the transmission line 212. According to an exemplary embodiment, the signal pad 220 may be integrally connected with the transmission line 212 to form a substantially single member, or may be formed as a separate member from the transmission line 212. For example, the signal pad 220 may be formed as a member substantially integral with the transmission line 212, and the end portion of the transmission line 212 may be provided as the signal pad 220.

According to an exemplary embodiment, the signal pad 220 may be electrically connected with a driving circuit unit (e.g., a radio frequency integrated circuit (RFIC), etc.). For example, a flexible printed circuit board (FPCB) may be bonded to the signal pad 220, and a circuit wiring of the FPCB may be electrically connected to the signal pad 220. For example, the signal pad 220 may be electrically connected to the FPCB using an anisotropic conductive film (ACF) bonding technique, which is a bonding method that allows electrical conduction up and down and insulates left and right using an anisotropic conductive film (ACF), or using a coaxial cable, but it is not limited thereto. The driving circuit unit may be mounted on the FPCB or a separate printed circuit board (PCB) to be electrically connected to the circuit wiring of the FPCB. Accordingly, the signal pad 220 and the driving circuit unit may be electrically connected with each other.

The antenna pattern layer 120 may further include a ground pad 230.

The ground pad 230 may be disposed around the signal pad 220. For example, a pair of ground pads 230 may be disposed to face each other with the signal pad 220 interposed therebetween. The ground pads 230 may be electrically and physically separated from the signal pad 220 and the transmission line 212 around the signal pad 220.

According to an exemplary embodiment, the signal pad 220 and the ground pad 230 may be formed in a solid structure made of the above-described metals or alloy in consideration of a reduction in power supply resistance, noise absorption efficiency and the like.

The antenna pattern layer 120 may further include a dummy pattern 240.

The dummy pattern 240 may be disposed around the antenna pattern 210 so as to be electrically and physically separated from the antenna pattern 210. For example, a separation region may be formed along an outer line of the antenna pattern 210 or a non-flat part 320 to separate the dummy pattern 240 from the antenna pattern 210.

According to an exemplary embodiment, the dummy pattern 240 may include the same metal or alloy as the antenna pattern 210, and may be formed in a mesh structure having the substantially same shape as the antenna pattern 210. According to an embodiment, the dummy pattern 240 may be formed in a mesh structure in which a portion of the conductive line forming the dummy pattern 240 is segmented.

The antenna element 100 according to the exemplary embodiment includes the antenna pattern 210 including the non-flat part 320 and the dummy pattern 240 disposed around the antenna pattern 210, such that when the antenna element 100 is applied to the display device, it is possible to significantly reduce or suppress the pattern from being viewed by the user.

Meanwhile, FIG. 2 illustrates an example in which the antenna element 100 includes one antenna pattern 210, but it is not limited thereto. For example, the antenna element 100 may include a plurality of antenna patterns arranged in an array form on the dielectric layer 110. According to an exemplary embodiment, when the antenna element 100 includes the plurality of antenna patterns, the sizes of the radiation bodies of each antenna pattern may be different from each other. In this case, the antenna element 100 may be provided as a multi-band antenna which is operated in a plurality of resonance frequency bands.

Figure 4:
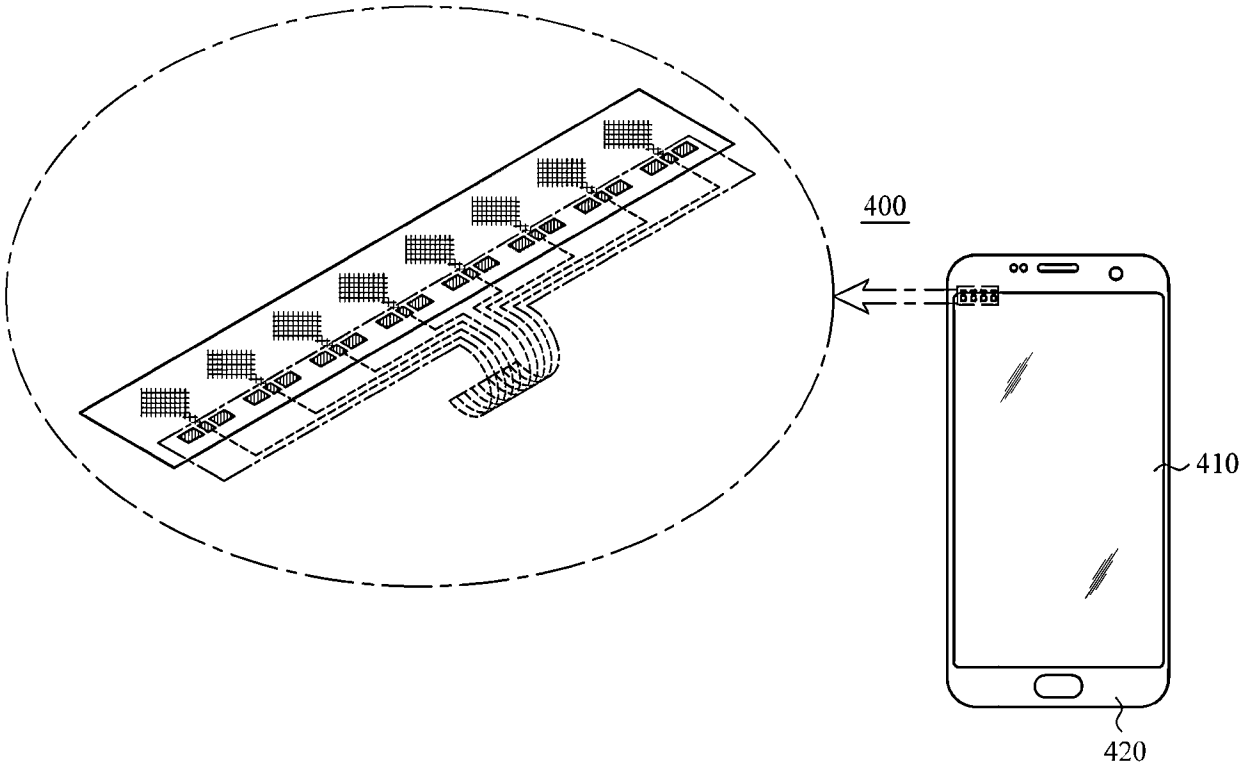
FIG. 4 is a schematic plan view illustrating a display device according to an exemplary embodiment.

FIG. 4 is a schematic plan view illustrating a display device according to an exemplary embodiment. More specifically, FIG. 4 is a view illustrating an external shape including a window of the display device.

Referring to FIG. 4, a display device 400 may include a display region 410 and a peripheral region 420.

The display region 410 may indicate a region in which visual information is displayed, and the peripheral region 420 may indicate an opaque region disposed on both sides and/or both ends of the display region 410. For example, the peripheral region 420 may correspond to a light-shielding part or a bezel part of the display device 400.

According to an embodiment, the above-described antenna element 100 may be mounted on the display device 400. For example, the antenna pattern 210 of the antenna element 100 may be disposed so as to at least partially correspond to the display region 410, and the signal pad 220 and the ground pad 230 may be disposed so as to at least partially correspond to the peripheral region 420.

The FPCB or PCB may be disposed in the peripheral region 420 together with a driving circuit unit (e.g., RFIC). By arranging the signal pad 220 of the antenna element 100 so as to be adjacent to the driving circuit unit, signal loss may be suppressed by shortening a path for transmitting and receiving signals.

The antenna element 100 includes the antenna pattern 210 and/or the dummy pattern 240 formed in a mesh structure, such that it is possible to improve the transmittance and significantly reduce or suppress the pattern from being viewed by the user. Accordingly, image quality in the display region 410 may also be improved, while maintaining or improving the desired communication reliability.

Experimental Example

Figure 5A:
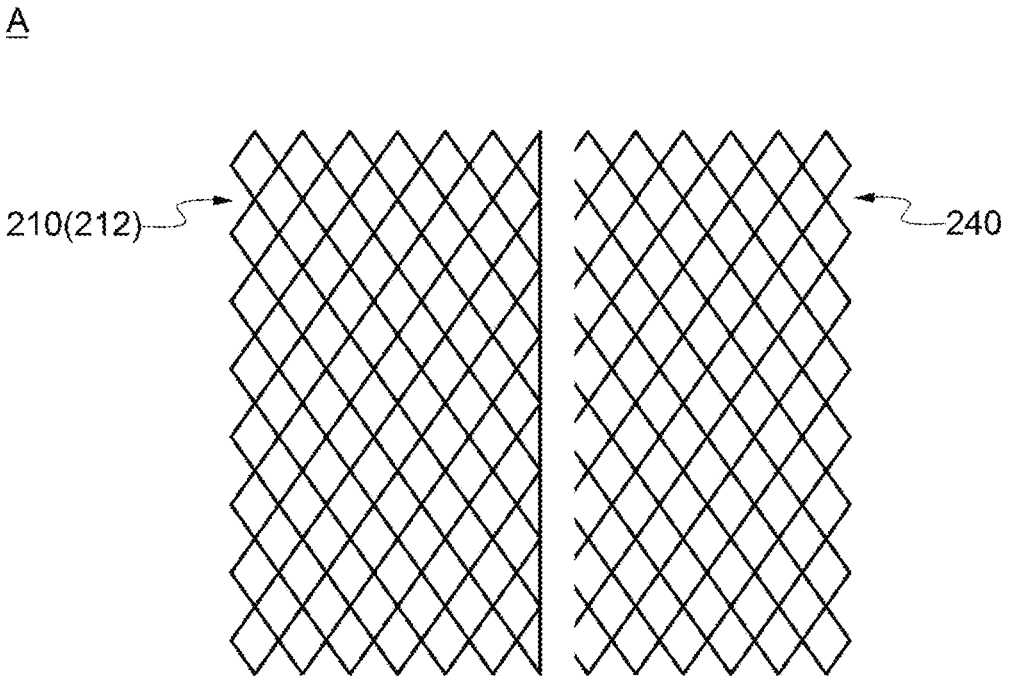
FIGS. 5A and 5B are enlarged views of the portions "A" and "B" in FIG. 2 of an antenna element according to a comparative example.
Figure 5B:
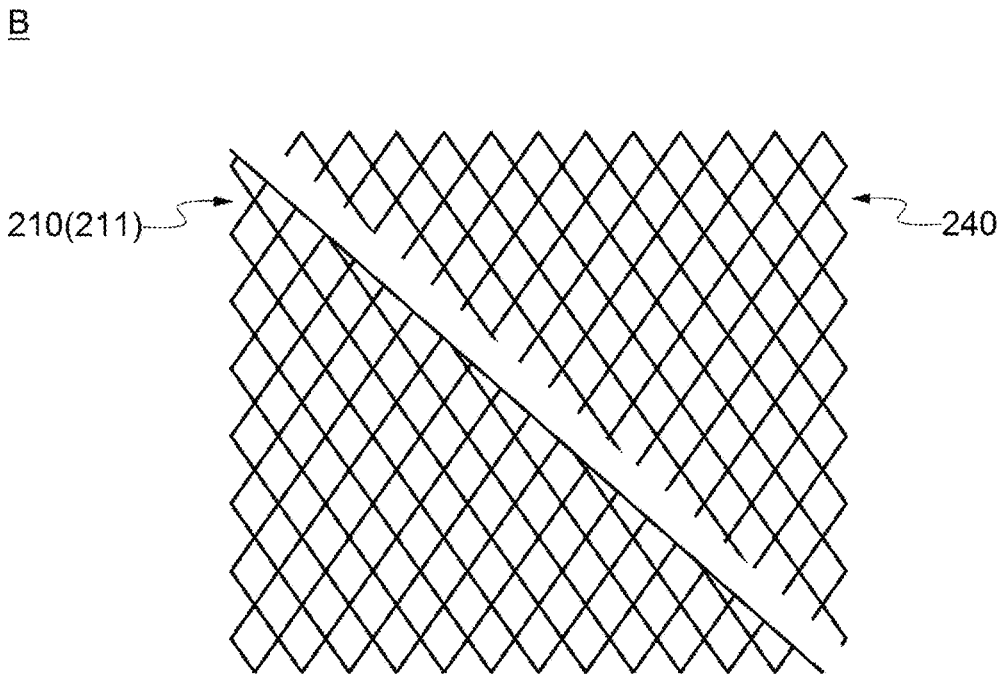

Two antenna elements as illustrated in FIG. 2 were formed. In this case, one antenna element was formed to have an edge of the antenna pattern shown in FIGS. 3A and 3B (an example), and the other antenna element was formed to have an edge of the antenna pattern shown in FIGS. 5A and 5B (a comparative example).

Figure 6:
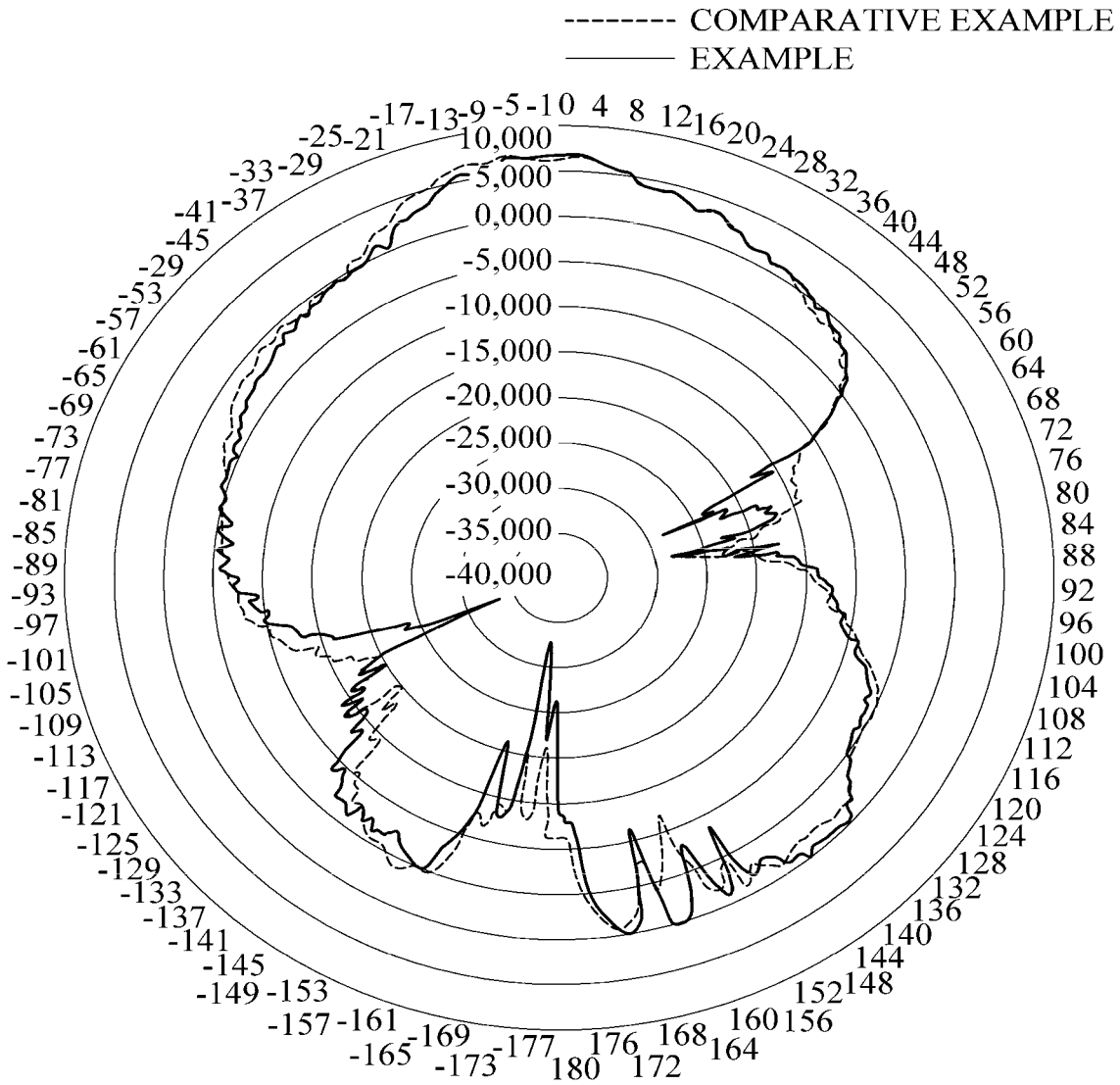
FIGS. 6 and 7 are views illustrating results of evaluating antenna performances of antenna elements prepared in the example and comparative example.
Figure 7:
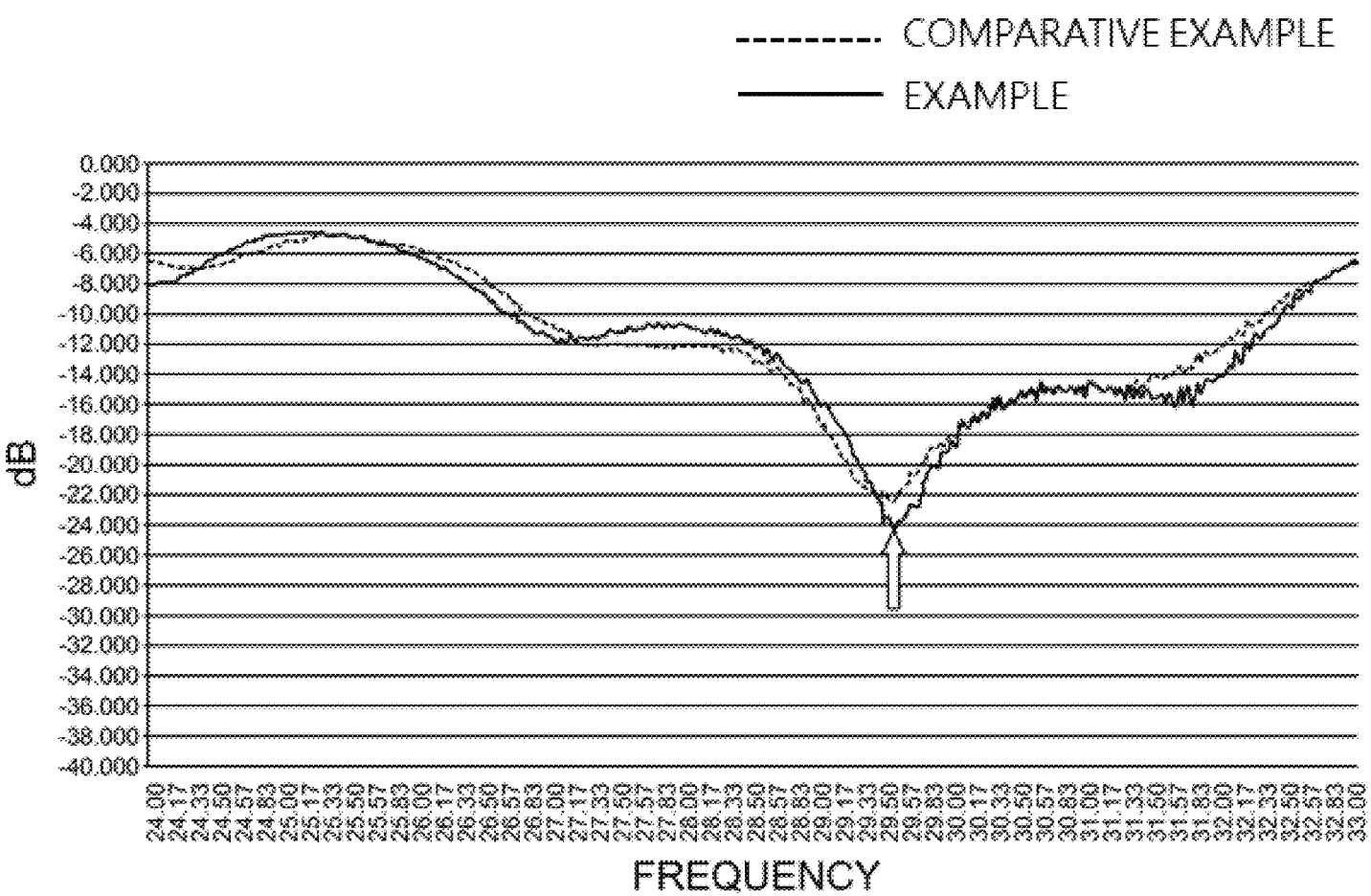
Figure 8:
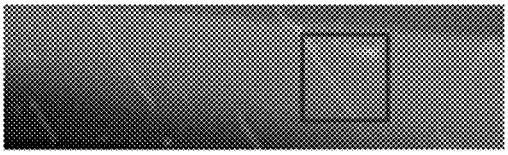
FIG. 8 is diagrams illustrating results of evaluating pattern visibilities of the antenna elements prepared in the example and comparative example.
Figure 8:
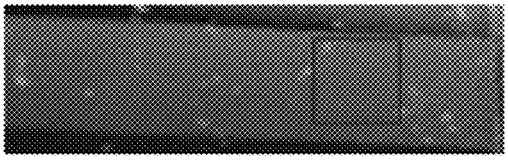

Then, an experiment for evaluating the antenna performances of the antenna elements prepared in the example and comparative example was performed, and the evaluated results shown in FIGS. 6 and 7 could be obtained. As a result of evaluating the pattern visibility, the results shown FIG. 8 could be obtained.

Referring to FIGS. 6 and 7, it can be seen that the radiation pattern of electromagnetic waves and S11 are similar to each other in the antenna elements of the comparative example and the example. In addition, referring to FIG. 8, it could be seen that, in the case of the antenna element of the example shown in (b) of FIG. 8, the pattern visibility was reduced compared to the antenna element of the comparative example shown in (a) of FIG. 8.

That is, it can be seen that the antenna element according to the example is superior to the antenna element according to the comparative example in terms of the pattern visibility, while maintaining the same antenna performance as the antenna element according to the comparative example.

The present invention has been described with reference to the preferred embodiments above, and it will be understood by those skilled in the art that various modifications may be made within the scope without departing from essential characteristics of the present invention. Accordingly, it should be interpreted that the scope of the present invention is not limited to the above-described embodiments, and other various embodiments within the scope equivalent to those described in the claims are included within the present invention.

What is claimed is:

1. An antenna element comprising:

a dielectric layer; and an antenna pattern formed in a mesh structure comprising a plurality of unit cells defined by a plurality of conductive lines on the dielectric layer, wherein an edge of the antenna pattern is formed along edges of outermost unit cells positioned outmost among the plurality of unit cells, a shape of the edge of the antenna pattern depends on positions and shapes of outermost unit cells, and the outermost unit cells are not regularly arranged, but are randomly arranged such that the edge of the antenna pattern has an irregular pattern.

2. The antenna element according to claim 1, wherein the plurality of unit cells including the outermost unit cells have the same size and shape.

3. The antenna element according to claim 1, wherein at least one of the outermost unit cells have a different size or shape from unit cells which are not positioned outermost among the plurality of unit cells.

4. The antenna element according to claim 1, wherein the antenna pattern comprises:

a radiation body; and a transmission line which extends from the radiation body.

5. The antenna element according to claim 4, further comprising:

a signal pad connected to an end of the transmission line; and a ground pad disposed around the signal pad.

6. The antenna element according to claim 5, wherein the signal pad and the ground pad are formed in a solid structure.

7. The antenna element according to claim 1, further comprising a dummy pattern disposed around the antenna pattern so as to be electrically and physically separated from the antenna pattern.

8. A display device comprising the antenna element according to claim 1.

* * * * *